United States Patent [19]

Kagaya

[11] 4,015,446

[45] Apr. 5, 1977

[54] PATTERNING SYSTEM FOR A KNITTING MACHINE

[75] Inventor: Yutaka Kagaya, Musashi-Murayama, Japan

[73] Assignee: Silver Seiko Co., Ltd., Kodaira, Japan

[22] Filed: Sept. 12, 1975

[21] Appl. No.: 612,861

[30] Foreign Application Priority Data

Sept. 14, 1974 Japan ..... 49-105522

[52] U.S. Cl. ..... 66/75.2

[51] Int. Cl.[2] ..... D04B 7/00; D04B 15/66

[58] Field of Search ..... 66/75 A, 154 A

[56] References Cited

UNITED STATES PATENTS

| | | | |
|---|---|---|---|
| 3,611,753 | 10/1971 | Krause | 66/75 R |
| 3,885,405 | 5/1975 | Bartels | 66/75 A |
| 3,899,899 | 8/1975 | Bartels | 66/75 A |

FOREIGN PATENTS OR APPLICATIONS

| | | | |
|---|---|---|---|
| 1,299,653 | 12/1973 | United Kingdom | 66/75 A |

*Primary Examiner*—Ronald Feldbaum
*Attorney, Agent, or Firm*—Woodhams, Blanchard and Flynn

[57] ABSTRACT

A patterning system for use with a hand-operated flat-bed knitting machine of the type wherein a carriage is mounted for reciprocative sliding movement along the needle bed, comprising a program providing means for providing a unit number of signals representative of data for needle selection for a course of knitting, a pair of needle selecting means mounted on said carriage at its opposite end portions for engagement with needles on the needle bed to select them in accordance with the pattern program, switch means for detecting the sliding direction of the carriage, control circuit means for controlling the needle selecting means so as to alternatively operate in response to the detection of the sliding direction of the carriage, thereby to carry out the needle selection in order to obtain the pattern on a knitted fabric according to the pattern program provided by the program providing means, without getting into confusion upon reversing of the sliding direction of the carriage.

12 Claims, 7 Drawing Figures

PATTERNING SYSTEM FOR A KNITTING MACHINE

This invention relates to a patterning system for use with a hand-operated flat-bed knitting machine of the type wherein a carriage is mounted for reciprocative sliding movement along the needle bed, having an electromagnet mounted on the carriage and adapted to be controlled for needle selection in accordance with a pattern program to obtain a pattern on a knitted fabric, and more particularly to a patterning system of this type which is adapted to read and store the pattern program for a course of knitting during every course of the sliding movement of the carriage and concurrently read out the pattern program stored in the preceding course of the sliding movement of the carriage to control the electromagnet for needle selection.

In this type of the patterning system, it is essential, in order to read out the pattern program stored in the form of digital electrical signals, in regular sequence in response to the carriage movement, keeping one to one correspondence with respective needles in operative position, to read and store the pattern program in the form of digital electrical signals each corresponding to the respective needles in the operative position and extract a corresponding bit of said stored digital electrical signals in response to the carriage movement.

In this connection, it is to be noted that in case of an ordinary hand-operated knitting machine having a pair of needle selecting means mounted on a carriage at its opposite end portions with reference to the sliding direction of the carriage and adapted to mechanically select the needles in response to, for example, such a digital electrical signal extracted as mentioned above and to be selectively made operative in association with the sliding direction of the carriage, an electrical signal indicating reversion of the sliding direction of the carriage is to be obtained separately to change the reading operation of the digital electrical signals in response to such reversion of the sliding direction. If such an electrical signal is not applied and the reading operation is not changed, the needle selection according to the pattern program will fall into utter disorder.

It is therefore an object of the present invention to provide a patterning system which is capable of reading a unit number of signals representative of data for needle selection for a course of knitting from a program carrier, in association with a carriage movement to store them in the form of digital electrical signals, while concurrently reading out signals stored in the preceding course of the carriage movement, in regular sequence in response to the carriage movement, keeping one to one corresponding relation with needles in operative position, and conventing the thus read out electrical signals into mechanical signals through an electromagnet member thereby to select the needles according to the pattern program on the program carrier.

It is another object of the present invention to provide a patterning system of the above-mentioned type, which has a pair of actuating means mounted on the opposite end portions of needle bed and switch means including a switch member mounted on the carriage and adapted to cooperate with said actuating means to operate the switch means to change the output signal thereof, whereby the output signal of the switch means represents the sliding direction of the carriage, and which is adapted to selectively apply the electrical signals according to the pattern program to either one of the electromagnets on the carriage in response to the output signal of the switch means thereby to select the needles according to the pattern program.

According to the present invention, there is provided a patterning system for use with a hand-operated flat-bed knitting machine of the type wherein a carriage is mounted for reciprocative sliding movement along the needle bed, having a pair of needle selecting means mounted on said carriage in a spaced relation with each other in the longitudinal direction of the needle bed for engagement with butts of needles to select them, each of said needle selecting means including an electromagnet, characterized in that it comprises program providing means for providing a unit number of signals representative of data for needle selection for a course of knitting, switch means for detecting the sliding direction of the carriage relative to said needle bed and providing an output representing said sliding direction of the carriage, and control circuit means for controlling the electromagnets to alternatively make said electromagnets operative in response to the output signal of said switch means to be selectively energized in accordance with the output signals of said program providing means.

This invention will be better understood from the following description taken in connection with the accompanying drawings, in which.

This invention will be explained referring to one preferred embodiment of the present invention as shown in FIGS. 1 to 9, which is used with a knitting machine adapted to carry out needle selection by one of needle selecting means positioned forward with reference to the sliding direction of a carriage.

Figure 4:
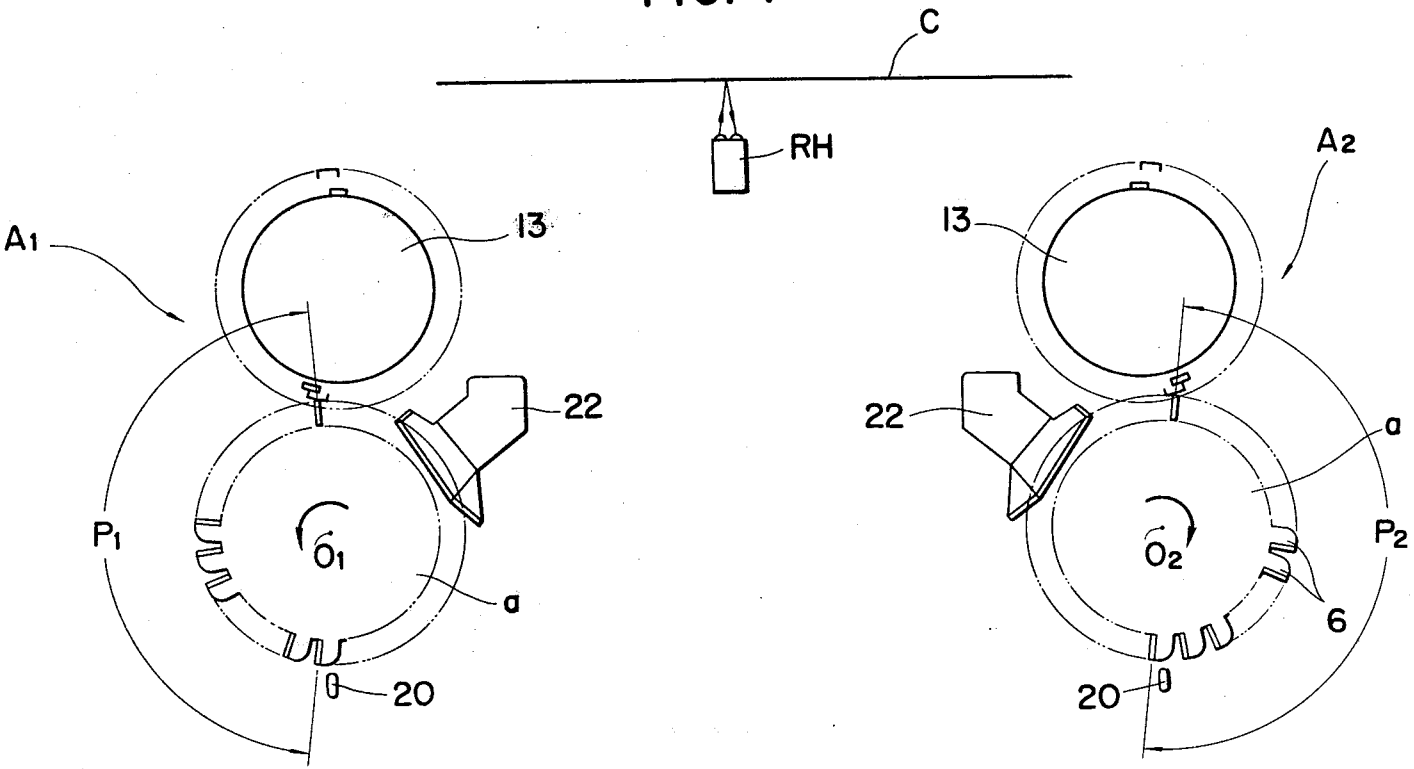
FIG. 4 is a diagrammatical view showing the relation between the right and left needle selecting means and needles.

A pair of needle selecting means $A_1$ and $A_2$ each adapted to mechanically carry out needle selection through engagement with butts of needles on a needle bed as shown in FIG. 4, are mounted on a carriage X at opposite end portions thereof in a spaced relation with each other in the longitudinal direction of the needle bed. The two needle selecting means $A_1$ and $A_2$ are structured substantially identically with each other, though being disposed symmetrically, so that the needle selecting means $A_1$ disposed on the left side of the carriage X as viewed in FIG. 4 is representatively referred to in the following description, assuming that it is in an operative condition.

The needle selecting means $A_1$ has a rotary member or a drum *a*. The drum *a* is provided with a gear 1 which is adapted to mesh with a gear 3. The gear 3 is in turn adapted to mesh with a rack 2 providing on a knitting machine body Y so that the drum *a* can rotate around a shaft 5 journalled on a forwardly inclined portion of a base plate 4 mounted on an end portion of the carriage X.

The drum *a* has a plurality of, for example, 24 needle selecting elements 6 mounted radially at equal angular spacings corresponding to pitches of the needles on the needle bed, in a concentric relation with the drum *a*. Each of the elements 6 has a bearing tail portion 6*a*, a projecting nose portion 6*b* at its outer portion, a bent leg portion 6*c* at its lower portion and a ball bearing head portion 6*d* at its upper portion. The element 6 is adapted to be rotatable or tiltable around on annular protuberance 7 formed on the drum *a* between an initial lower stable position where the bent portion 6c abuts against the upper face of the gear 1 and is brought into contact with a butt of the needle 20 when it arrives at a needle selecting position as shown in FIG. 4, and an operative upper stable position where the inner face of the element 6 abuts against the periphery of the drum *a* and the bent portion 6*c* is not in a position to contact with the butt of the needle 20 when it reaches the needle selecting position.

A ball 9 normally urged downwardly by a leaf spring 8 is disposed in association with each of the elements 6 to depress it to hold it in either one of the stable positions. In order to change the positions of the element 6, to wit, change the positions from its initial stable position to its operative stable position, and vice versa, a superior force overwhelming the force of the leaf spring 8 must be applied to the element 6. Thus, if such a superior force has not been applied against the force of the spring 8, the element 6 can not change its position. However, once the element 6 passes over a neutral position between the two stable positions, the element 6 is automatically or forcibly brought into either one of the stable positions by the action of the spring 12.

The gear 3 is adapted to rotate around a shaft 10 extending perpendicularly from the base plate 4. The gear 3 is formed with a cylindrical portion 3*a* at its central portion which is fitted around the shaft 10. To this cylindrical portion 3*a* of the gear 3, a rotary member *b* is fixed for conjoint rotation therewith.

A plurality of, for example 24 transmission elements 11 made of a magnetic material are mounted on the rotary member *b* with a pitch equal to that of the elements 6 in a concentric relation with the drum *b*.

Figure 1:
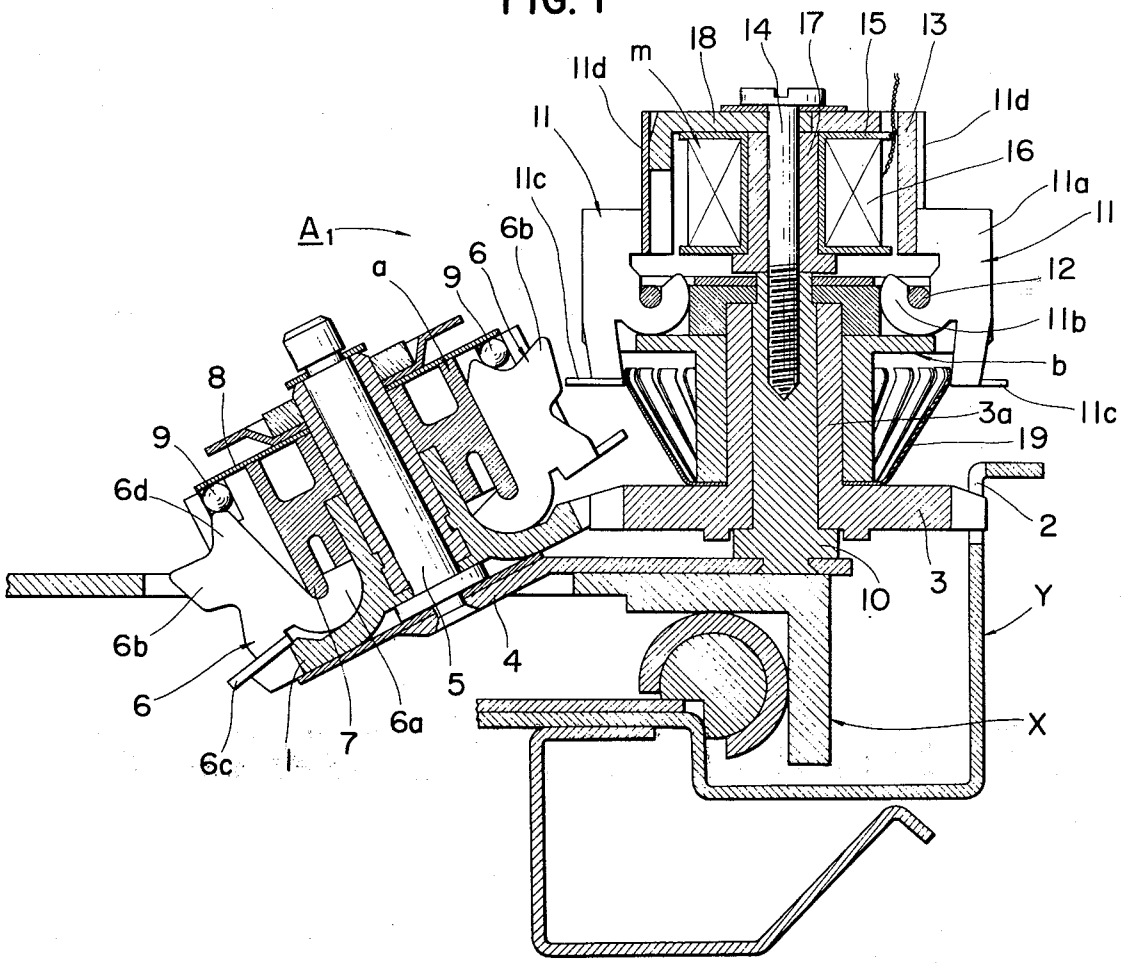
FIG. 1 is a sectional view of needle selecting means mounted on a knitting machine according to the present invention.
Figure 3:
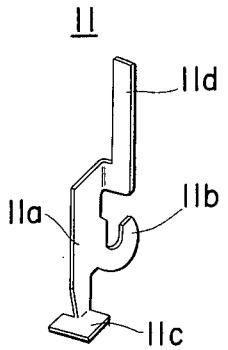
FIG. 3 is a perspective view of a transmissiom element employed in the present invention.

Each of the elements 11 is formed of a sheet of plate material and formed with a base portion 11a extending in a radial plane of the drum *b*, a bearing tail portion 11*b* extending in the same plane as said base portion 11*a* at its intermediate inner portion, a bent leg portion 11*c* extending in a horizontal plane at its lower end portion and a vertical portion 11*d* extending in a plane normal to the plane of the base portion 11a at its upper portion as shown in FIG. 3. The thus formed elements 11 are tiltable individually around an annular shaft 12 which is made of a wire bent into an annular shape and connected to the rotary member *b*.

A guide cylinder 13 made of a non-magnetic material is fixedly secured to the shaft 10 extending from the base plate 4 with a screw 14. Inside the cylinder 13, a coil 16 wound around a bobbin 15 is mounted.

Figure 2:
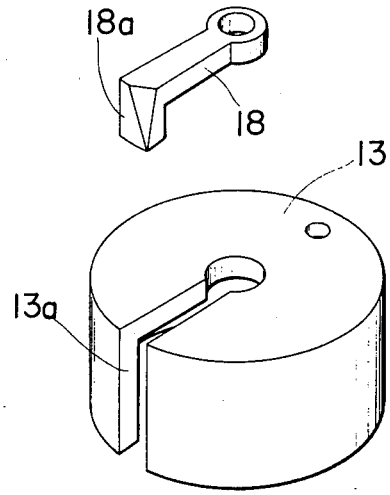
FIG. 2 is an exploded view showing a guide cylinder and an attracting member employed in the present invention.

As shown in FIG. 2, the cylinder 13 is formed in a cap-like shape and adapted to accommodate a cylindrical core 17 therein. The core 17 is secured with the screw 14 inserted there through between the cylinder 13 and the top end of the shaft 10. The coil 16 is mounted around the core 17 be setting the bobbin 15 on the core 17 to form an electromagnet *m*.

The guide cylinder 13 is formed with a slot 13a extending radially on its upper cylinder portion from its center and extending through its cylindrical portion along an axis of the cylinder 13. An attracting member 18 made of a magnetic material and having a vertical end portion 18*a* bent downwardly in a vertical plane as viewed in FIG. 2 is fitted in the slot 13*a*. The thus mounted attracting member 18 is in contact with the core 17 at its top circular portion and acts as a yoke to form a magnetic circuit emanating from the core 17. On the other hand, the outer face of the attracting member 18 is adapted to lie on the same cylindrical surface as of the cylinder 13 so that the cylinder of a non-magnetic material may have a magnetic portion of a given angular spacing.

With reference to the guide cylinder 13 fixedly secured to the shaft 10 together with the attracting member 18 fitted to the cylinder 13, the elements 11 are adapted to rotate, sliding on the periphery of the cylinder 13. A leaf spring 19 is fixed between the upper surface of the gear 3 and the lower end of the drum *b*. The leaf spring 19 is divided, at its tip end portion, into fingers as many as the number of the elements 11 and bent upwardly to expand radially so as to be associated with respective elements 11 to urge the lower portions of the elements 11 outwardly.

Thus, each of the elements 11 is normally in an initial position to keep its vertical portion 11d abutting against the periphery of the cylinder 13 by the action of the leaf spring 19 and rotates, keeping the position, on the periphery of the cylinder 13. The element 11 is, however, tilted downwardly to an operative position, disengaging from the periphery of the cylinder 13 when a force overwhelming the force of the leaf spring 19 is applied downwardly to the element 11.

The operation of the thus constructed needle selecting means $A_1$ will be explained in the following.

The elements 6 on the drum *a* and the elements 11 on the rotary member *b* are so disposed that the rotational locus of the bent portions 6*b* (of the elements 6 kept in the initial stable position) and the rotational locus of the bent portions 11*c* (of the elements 11 kept in the initial position so that the vertical portions 11d abut against the periphery of the cylinder 13), meet each other at a predetermined position before the mechanical needle selecting position of the elements 6 as shown in FIG. 4. In other words, in the course of the rotations of the elements 6 and the elements 11 (kept in their respective initial positions), the bent portions 6*b* of the elements 6 and the bent portions 11*c* of the elements 11 are brought into engagement with each other sequentially at said predetermined position and maintain such engagement while the drum *a* and the rotary member *b* move or rotate by substantial one pitch or while the carriage X is moved one pitch.

When the electromagnet *m* is in a deenergized condition, the element 6 engaging with the confronting element 11 is kept in the initial stable position, while the element 11 in engagement with said element 6 is displaced or tilted by the element 6 engaging therewith. On the other hand, when the electromagnet *m* is energized, the latter element 11 is kept in the initial position while the former element 6 is biased or tilted by said latter element 11 to the operative position.

Stated illustratively, the elements 11 are so disposed that one of the elements 11 positioned at the predetermined engaging position may face, at its vertical portion 11*d*, the periphery of the vertical end portion 18*a* of the attracting member 18, or may be disposed within the effective magnetic force range of the electromagnet *m*. Accordingly, when the electromagnet *m* is deenergized, since the element 11 is not attracted by the attracting member 18 and the force of the spring 8 urging the element 6 is superior to the force of the spring 19 applied to the element 11, the element 6 overcomes the element 11 and keeps its original position and the element 11 is gradually displaced or tilted to disengage from the cylinder 13. The displaced element 11 is disengaged from the element 6 and restored to its initial position by the action of the spring 19 when passing over the attracting member 18 in the course of further rotation.

On the other hand, when the electromagnet *m* is energized, the element 11 is attracted by the attracting member 18 so that the force acting on the element 11, namely the force exerted by such attraction and the force of the spring 19, becomes superior to the force of the spring 8 applied to the element 6. Accordingly, the element 11 conquers the element 6 and keeps its initial position, and the element 6 is gradually displaced or tilted to pass over the neutral position. The element 6 is, then, automatically tilted to the operative stable position by the action of the spring 8.

Thus, the elements 6 are selected or set one by one so as to be tilted to the operative position or kept in the initial position depending upon the state of the electromagnet *m*, namely, whether the magnet *m* is energized or deenergized, and rotated to the needle selecting position keeping the set position.

The elements 6 tilted to the operative position are automatically restored to the initial position by a resetting member 22 after the needle selecting position. Stated illustratively, the resetting member 22 is provided on the carriage X between the needle selecting position and the position where the element 6 is brought into engagement with the element 11, so that when the element 6 tilted to the operative position reaches the resetting member 22 in the course of rotation of the drum *a*, the resetting member 22 engages with the projecting nose portion 6*b* of the element 6 to rotate the element 6 around the protuberance 7, overcoming the action of the spring 8 according to the rotation of the drum *a*. Thus, the element 6 is restored to its initial stable position to abut against the cylinder 13.

With the thus constructed needle selecting means $A_1$ and $A_2$, the needle selection can be effected regardless of the number of the elements 6. The number of the needles to be associated with one course of knitting of a unit pattern, or unit number of needle selection, is determined not by the number of the elements 6 but by a number of controls of the electromagnet *m*, namely, a number of energization or deenergization operations of the electromagnet *m*. As the number of controls is electrically determined arbitrarily, the unit member of needle selection can be determined to be as much as the number of the elements 6, or may be determined to be more or less than the number of the elements 6.

Furthermore, the element 11 is not adapted to be brought into engagement with the confronting element 6 after keeping the position controlled by the electromagnet *m* for a predetermined time, or to convey the signal for needle selection after storing for a predetermined time, but is adapted to convey the signal to the element 6 concurrently with the control by the electromagnet *m*. Accordingly, the number of the elements 11 is not necessarily the same as the number of the elements 6 to carry out the unit pattern knitting.

The left needle selecting means $A_1$ is structured as mentioned above and the right needle selecting means $A_2$ is structured substantially identically with the left needle selecting means $A_1$ but symmetrically disposed therewith.

The controlling operation of the thus formed needle selecting means $A_1$ and $A_2$ will be explained in the following.

Figure 5:
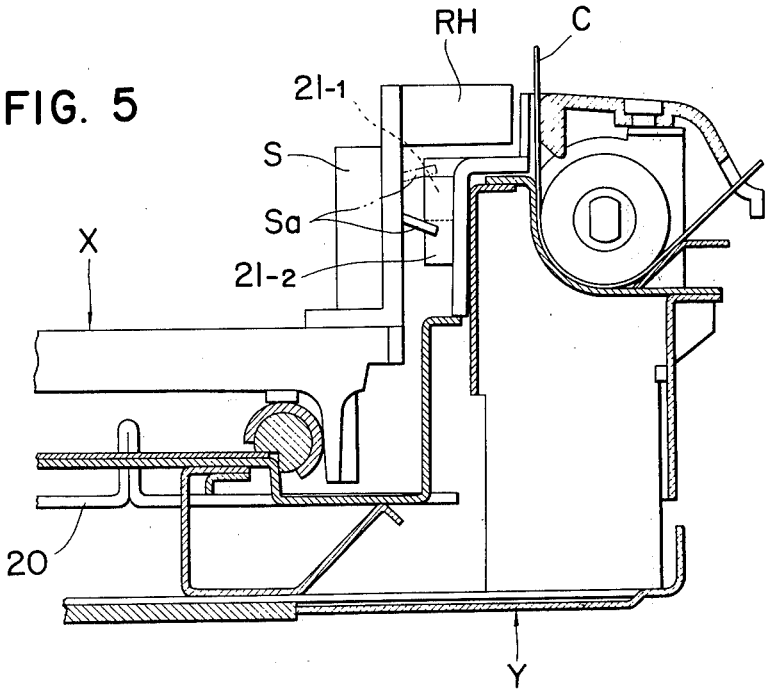
FIG. 5 is an explanatory side view showing the positional relation between a reading head, switch means and a program carrier employed in the present invention.
Figure 6:
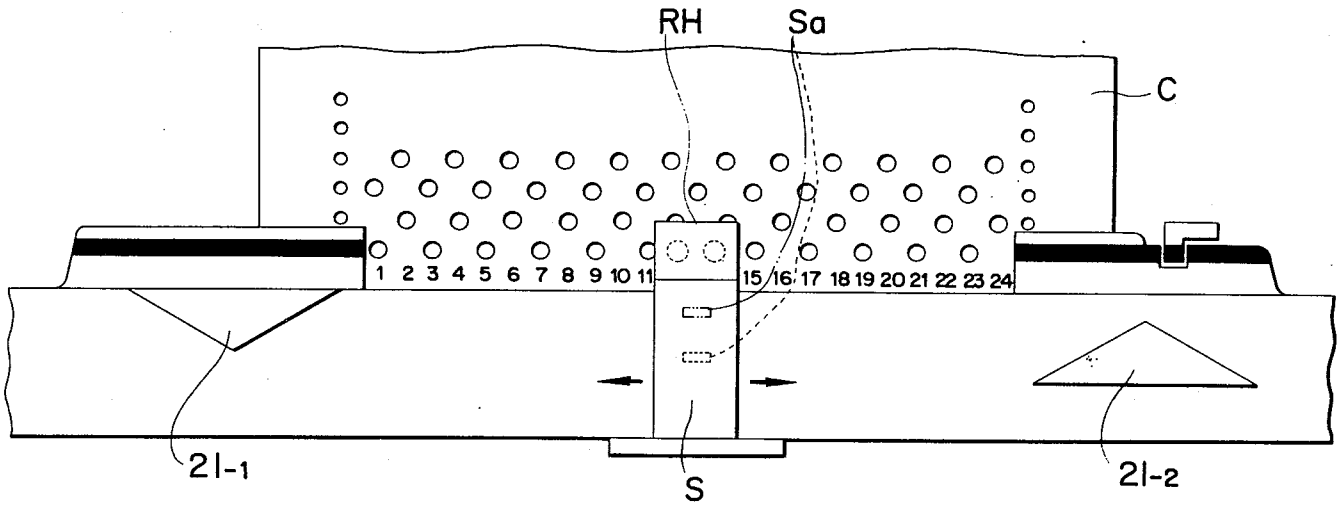
FIG. 6 is an elevational view of FIG. 5.
Figure 7:
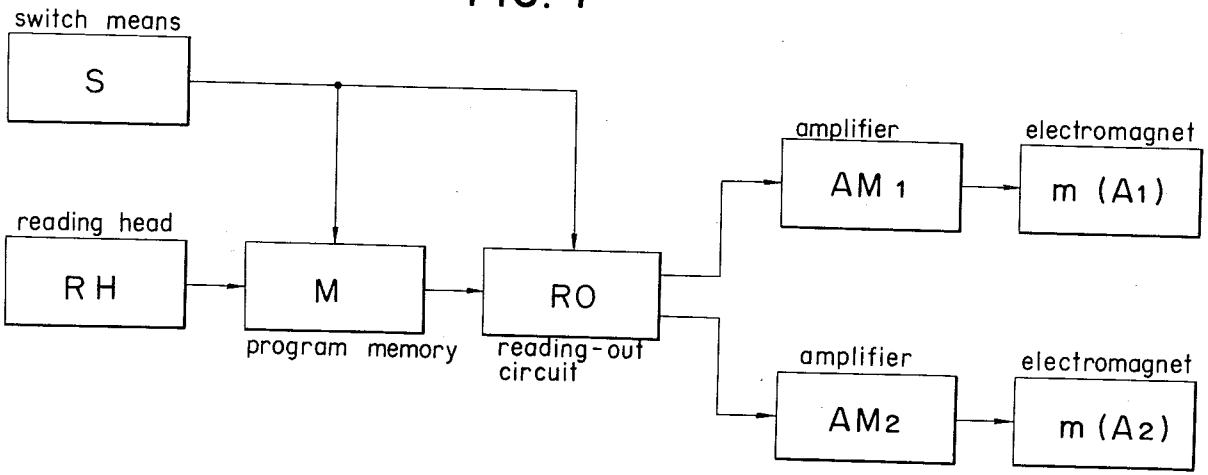
FIG. 7 is a block diagram showing an electrical connection of the present patterning system.

A program carrier C is made of, for example, a punched card and disposed at a predetermined portion of the knitting machine body Y as shown in FIGS. 5 and 6. The program carrier C carries a pattern program formed of a plurality of rows of signals for data for needle selection, each row including a unit number of signals, for example, 24 bit signals expressed in the form of presence or absence of a hole, as data for needle selection for a course of knitting.

A reading head RH is provided at a predetermined portion of the carriage X and formed of a luminous material for irradiating the program carrier C and a photoelectric transducer for receiving a reflected light. The reading head RH is adapted to sweep the program carrier C in the course of the carriage movement in the leftward and rightward directions to produce outputs of serial binary electrical signals containing a predetermined number of bits, for example, 24 bits. The reading head RH is electrically connected to a program memory M connected in a control circuit for controlling the electromagnets *m* (See FIG. 7), and the serial binary electrical signals obtained by the sweep of the reading head RH are stored in the program memory M. The memory stored in the program memory M is read out in the course of the carriage movement in the leftward direction independently from the reading out of the memory in the course of the carriage movement in the rightward direction. Stated illustratively, means for detecting the direction of the carriage movement are provided in the present invention. The means is shown in the form of switch means S mounted on the carriage X in the present embodiment.

The switch means S has a lever Sa which is adapted to be actuated in association with the movement of the carriage X by actuating cam 21-1 or 21-2 disposed on the knitting machine body at its opposite ends, respectively, thereby to product outputs of electrical signal identifying the directions of the movement of the carriage X when the lever Sa is between the actuating cams 21-1 and 21-2. It is preferable to set the actuating cams 21-1 and 21-2 on the needle bed displaceably in the longitudinal direction of the needle bed so that the sliding range of the carriage X may be adjustable according to a width of the knitting.

The serial binary electrical signals from the reading head RH are controlled by the electrical signal from the switch means S and stored in the program memory M, separately.

As a reading out circuit RO is adapted to be controlled by the electrical signal from the switch means S, the stored serial binary electrical signals are read out in such a manner that the signals stored in the course of the movement of the carriage X in the leftward direction is read out in the course of the succeeding movement of the carriage X in the rightward direction and that the signals stored in the course of the rightward movement of the carriage X is read out in the succeeding leftward movement of the carriage X. For the control by the electrical signal from the switch means S, a known gate circuit may be employed.

The serial binary electrical signals stored are read out one bit by one bit in regular sequence in response to every advance of the carriage X by a distance corresponding to a pitch of the needles on the needle bed in similar manner as known already.

The serial binary electrical signal read in the course of the leftward movement of the carriage X is amplified through an amplifier $AM_1$ and applied to the left electromagnet *m*, while the serial binary electrical signal read in the course of the rightward movement of the carriage X is applied to the right electromagnet *m* after amplification by an amplifier $AM_2$.

Thus, it will be apparently seen that when the carriage X moves in the leftward direction, the left electromagnet *m* is controlled so as to be energized or deenergized in association with every one pitch movement of the carriage X thereby to control the elements 6 on the left drum *a* so as to bring them into the operative position or keep them in the initial position, and that when the carriage X moves in the rightward direction, the right electromagnet *m* is controlled thereby to control the elements 6 on the left drum *a* so as to bring them into the operative position or keep them in the initial position.

In this connection, it is to be noted that when the carriage X moves leftwardly, only the left electromagnet *m* is energized or deenergized so as to bring the left needle selecting means $A_1$ into operative condition and that when the carriage X moves rightwardly, only the right electromagnet *m* is energized or deenergized so as to bring the right needle selecting means $A_2$ into operative condition.

The elements 6 on the drum *a* of the left needle selecting means $A_1$ controlled so as to be selectively tilted into the operative position or kept in the initial position, further rotated by $P_1$ pitches to reach the needle selecting position and the elements 6 on the right needle selecting means $A_2$ controlled so as to be selectively tilted into the operative position or kept in the initial position, rotate by $P_2$ pitches to reach the needle selecting position, where the elements 6 are selectively brought into contact with the butts of the needles 20 according to their respective positions controlled for the needle selection.

The difference between the number of the pitches of $P_1$ and $P_2$ is caused according to the bending direction of the bent portions 6*c* of the elements 6.

As mentioned above, the present invention is capable of reading the pattern program on the program carrier in association with the movement of the carriage, while storing the program in the program memory in the form of digital electrical signals, concurrently reading out the electrical signals stored in the preceding course of the carriage movement, in regular sequence in response to the sliding movement of the carriage, keeping one to one corresponding relation with the respective needles in the operative position, and converting the electrical signals thus read out into mechanical signals to carry out the needle selection. Furthermore, the present invention is provided with a pair of actuating means mounted on the needle bed at its opposite end portions which are adapted to cooperate with the switch means provided on the carriage to detect the sliding direction of the carriage to alternatively actuate the electromagnets by the output of said detection, whereby the needle selection can be effected in order without falling into confusion upon reversion of the sliding direction of the carriage.

What is claimed is:

1. A patterning system in a hand-operated straight knitting machine comprising, in combination:

a needle bed;

movable knitting needles mounted in said needle bed and each having a butt;

a carriage mounted for reciprocative sliding movement along said needle bed;

a pair of needle selecting means mounted on said carriage in a spaced relation from each other in the longitudinal direction of said needle bed for engagement with said butts of said needles to select the latter, each of said needle selecting means including an electromagnet;

program providing means for providing a unit number of electric signals representative of data for needle selection for a course of knitting;

switch means for detecting the moving direction of said carriage relative to said needle bed and providing an electric signal representative of the moving direction of said carriage; and control circuit means for control of said electromagnets including a program memory electrically connected with said program providing means for temporarily storing therein signals provided by said program providing means, said program memory being controlled by and connected to said switch means, and read out means for successively reading out signals stored in said program memory in regular sequence in response to the carriage movement for energizing said electromagnets in accordance with said read out signals and including a portion responsive to the output signal of said switch means for selectively determining which of said electromagnets is to be supplied with and energized in accordance with the signals being read out of said program memory.

2. A patterning system as claimed in claim 1, including a pair of actuating means mounted on the opposite end portions of the needle bed, said switch means comprising a member mounted on said carriage and actuatable by said actuating means to change the output signal of the switch means whereby said output signal is representative of the sliding direction of the carriage while said member is within the range between said actuating means.

3. A patterning system as claimed in claim 1, including means connecting the output of said switch mean to said read out means for reading out data signals from said program memory stored in the preceding course of sliding of the carriage, while said connection of said switch means to said program memory causes the latter to concurrently store fresh data signals later to be read out in the succeeding return course of sliding of the carriage in response to the next output signal from said switch means.

4. A patterning system as claimed in claim 1, in which each of said needle selecting means further comprises a drum rotatable in synchronism with the sliding movement of the carriage and having thereon a plurality of elements each tiltable to a position in which such element is engageable with a said butt of a said knitting needle to select same during rotation of the drum, each of said electromagnets being mounted to operate, when energized, the element to be tilted to said position.

5. A patterning system as claimed in claim 4, in which each of said needle selecting means further comprises means for restoring said elements from said position before they approach the electromagnet during rotation of the drum, whereby the signals applied to said elements by the electromagnet in the form of selective energization are kept stored temporarily by the elements until after completion of the needle selecting operation thereby.

6. A patterning system as claimed in claim 1, in which said program providing means comprises a program carrier provided on the needle bed and having thereon a pattern program applied thereto, and a reading head for reading the pattern program on said program carrier in association with the carriage movement.

7. A patterning system as claimed in claim 2, in which each of said actuating means is an actuator cam which is mounted on the needle bed and said program providing means comprising a program carrier disposed between both of said actuator means.

8. A patterning system as claimed in claim 2, in which each of said actuating means is displaceably mounted relative to and in the longitudinal direction of the needle bed and including means connecting said electromagnets in series with said program memory through said read out means for applying the signals stored in said program memory as a mechanical displacement to one or more operative knitting needles located within the range between said actuating means.

9. A patterning system as claimed in claim 1, wherein said read out means is a gate circuit connected to, and controllable by the output signal of said switch means.

10. A patterning system as claimed in claim 1, including a pair of amplifiers each connected to a respective one of said electromagnets and actuable for driving same, said read out means having a control input connected to said switch means for applying the binary electrical signal read out therethrough to one said amplifier with said carriage moving in one said direction and to the other said amplifier with said carriage moving in the other direction.

11. A patterning system as claimed in claim 10, including first and second activating cams fixed with respect to said needle bed adjacent the edges of the material width to be knitted, said switch means being supported on said carriage and actuable by a respective said cam at each end of carriage travel for providing said signal representative of carriage moving direction.

12. A patterning system as claimed in claim 1, in which each said needle selecting means includes a number of needle butt shifting levers presented in sequence to the needles of said bed during a carriage pass in the corresponding direction, the number of needles selectable in one pass of said carriage not being limited to the number of needle butt shifting levers of said needle selecting means but rather said number of selectable needles corresponding to the maximum number of said signals stored in said program memory for one course of movement of said carriage.

* * * * *